US008835838B2

(12) United States Patent
Parr et al.

(10) Patent No.: US 8,835,838 B2
(45) Date of Patent: Sep. 16, 2014

(54) METHOD AND APPARATUS FOR ANALYSIS AND ION SOURCE

(71) Applicant: Scientific Analysis Instruments Limited, Manchester (GB)

(72) Inventors: Victor Carl Parr, Manchester (GB); Alex Pollard, Stockport (GB)

(73) Assignee: Scientific Analysis Instruments Limited, Old Trafford, Manchester (GB)

( * ) Notice: Subject to any disclaimer, the term of this patent is extended or adjusted under 35 U.S.C. 154(b) by 0 days.

(21) Appl. No.: 14/054,594

(22) Filed: Oct. 15, 2013

(65) Prior Publication Data

US 2014/0103205 A1 Apr. 17, 2014

(30) Foreign Application Priority Data

Oct. 12, 2012 (GB) ..... 1218380.2

(51) Int. Cl.
*H01J 49/10* (2006.01)

(52) U.S. Cl.
CPC ..... *H01J 49/10* (2013.01)
USPC ..... 250/288; 250/423 R; 250/424

(58) Field of Classification Search
USPC ..... 250/288, 423 R, 424
See application file for complete search history.

(56) References Cited

U.S. PATENT DOCUMENTS

| | | | | |
|---|---|---|---|---|
| 4,849,628 | A | 7/1989 | McLuckey et al. | |
| 8,173,959 | B1 * | 5/2012 | Boumsellek et al. | 250/288 |
| 2007/0007448 | A1 | 1/2007 | Wang | |

FOREIGN PATENT DOCUMENTS

| | | | |
|---|---|---|---|
| EP | 2450942 | A2 | 5/2012 |

* cited by examiner

*Primary Examiner* — Kiet T Nguyen
(74) *Attorney, Agent, or Firm* — Leydig, Voit & Mayer, LLP

(57) ABSTRACT

An ion source is formed by a chamber 2. A capillary tube 6 forms an inlet to the chamber. A heater 7 is associated with the capillary tube to heat air drawn into the chamber. An electrode 4 is provided in the chamber and maintained at a voltage in the range 100 to 500 volts. In use the source is connected to an analyzer such as a mass spectrometer 10. The capillary tube is open to the atmosphere. Pressure in the chamber is reduced, and pressure in the analyzer is further reduced. An electrical potential is applied to the electrode to create a discharge within the chamber. Ionization of air molecules within the chamber leads to ionization of any sample molecules present in the chamber. Ions are swept into the analyzer for analysis.

19 Claims, 4 Drawing Sheets

METHOD AND APPARATUS FOR ANALYSIS AND ION SOURCE

CROSS REFERENCE TO RELATED APPLICATIONS

This application claims the benefit of United Kingdom Patent Application No. 1218380.2, filed on Oct. 12, 2012, in the United Kingdom Intellectual Property Office, the entire disclosure of which is incorporated herein by reference.

TECHNICAL FIELD OF THE INVENTION

The present invention relates to an ion source and to an apparatus and method for analysis of a sample. The invention relates particularly, but not exclusively, to analysis of a sample present in atmospheric air.

BACKGROUND TO THE INVENTION

Historically, generation of ions for mass spectrometric analysis has required ionisation of a sample in a vacuum or near vacuum.

More recently various techniques have been developed which enable a sample to be ionised at or near atmospheric pressure, which significantly increases the utility of mass spectrometric analysis. One such technique is known as DART (direct analysis in real time). With DART a neutral carrier gas, typically Helium, is ionised at atmospheric pressure by a kilovolt electrical discharge and the ionised gas is directed on to a sample to be analysed in order to ionise the sample. Ionisation of the sample occurs at atmospheric pressure via a series of competing reactions beginning with Pennington ionisation in which a long-lived (Metastable) excited state Helium molecule induces an energy transfer to the sample resulting in formation of a radical ion. This ionisation is arranged to take place in a small gap between the source of ionised Helium and the inlet to a mass spectrometer so that sample ions are drawn into the mass spectrometer for analysis.

A drawback with the DART technique is the need to use a costly carrier gas such as Helium. Also, high electrical potentials are required to ionise the carrier gas at atmospheric pressure which, in some implementations, may run the risk of exposing those high potentials to users. There is also a need to position a sample for analysis suitably in relation to the ionised gas source and inlet to the mass spectrometer, which can be inconvenient.

Embodiments of the present invention have been made in consideration of these problems.

SUMMARY OF THE INVENTION

According to an aspect of the present invention there is provided a method of ionising a sample for analysis including the steps of drawing atmospheric air containing the sample into a chamber in which the pressure is less than atmospheric pressure, heating the air and creating an electrical discharge by applying a DC electrical potential in the range 100-500 volts to an electrode in the chamber thereby to bring air molecules in the chamber into an excited state and permitting the excited state molecules to react with the sample to generate sample ions.

According to another aspect of the present invention there is provided an ion source comprising a chamber, an electrode disposed in the chamber, a power supply arranged to maintain the electrode at a DC potential in the range 100-500 volts relative to the chamber, an inlet to the chamber, a heater arranged to heat air drawn into the chamber through the inlet and a vacuum source connected to the chamber, the vacuum source and inlet being configured to maintain pressure in the chamber below atmospheric pressure, when the inlet is open to the atmosphere.

According to another aspect of the present invention there is provided apparatus for analysis comprising an ion source according to the previous aspect connected to an analyser, the analyser being provided with a vacuum source arranged to maintain a region of the analyser connected to the ion source at a pressure lower than that in the chamber of the ion source.

The invention permits analysis of a sample contained in atmospheric air. Ionisation takes place in the chamber. Owing to the reduced pressure within the chamber a discharge can be created in the chamber by applying a significantly lower electrical potential than with prior art techniques performed at atmospheric pressure. An ion column created by the discharge may produce breakdown products of molecules contained in air. The main products are those of Oxygen. In this process $O^3$ forms free electrons which are available to ionise sample molecules present in the chamber. Water molecules present in air are also ionised to produce Hydrogen ions which can chemically ionise samples. The free electrons have the property of being at low energy so low energy electron ionisation may be observed. In contrast with prior DART techniques no neutral carrier gas need be introduced into the chamber.

Pressure in the chamber may be maintained at or less than 2 torr and may be about 1 torr. Atmospheric air may be drawn into the chamber through a capillary tube. The heater may be associated with the inlet to the chamber so as to heat air as it is drawn into the chamber. The heater may be disposed around the capillary tube.

The electrical discharge may be created in the chamber by applying a DC electrical potential in the range 200-400 volts to an electrode in the chamber. The electrode may be a pin electrode. A discharge column may be created between the electrode and walls or other parts of the chamber.

The chamber may be provided with an outlet and electric and/or electrostatic lenses may be provided in the chamber arranged to sweep ions formed in the chamber through the outlet. The outlet may be substantially circular and have a diameter of about 2 mm.

Where an analyser is provided ions generated in the chamber may be swept though the outlet into the analyser. A pressure step may be provided between the chamber and the analyser, so that ions passing into the analyser pass into a region where the pressure is lower than that in the chamber. Pressure in the analyser may be equal to or less than $10^{-2}$ torr, or in the range $10^{-2}$ torr to $10^{-4}$ ton.

DETAILED DESCRIPTION OF THE INVENTION

In order that the invention may be more clearly understood an embodiment thereof will now be described, by way of example only, with reference to the accompanying drawings, of which:

Figure 1:
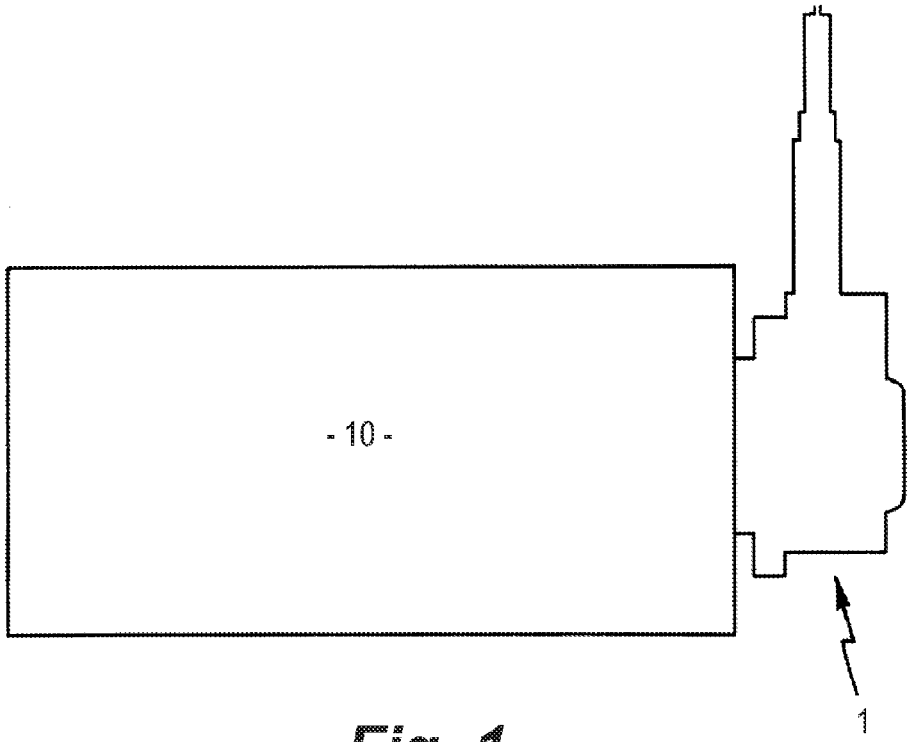
FIG. 1 is a plan view of an ion source and mass spectrometer.
Figure 2:
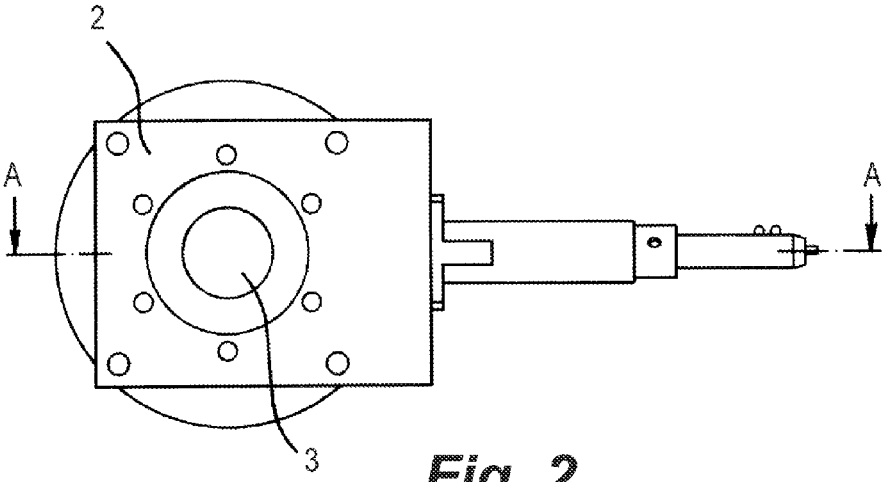
FIG. 2 is a side view of the ion source of FIG. 1.
Figure 3:
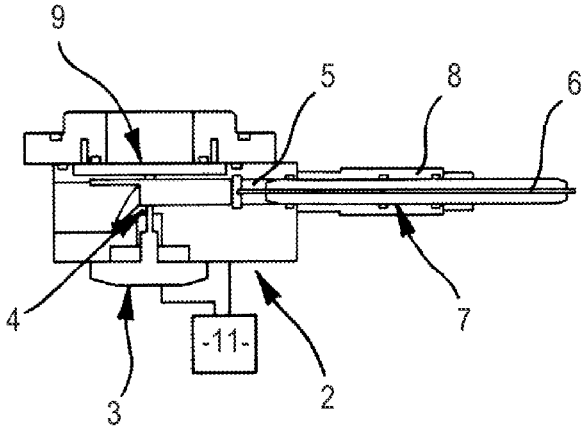
FIG. 3 is a cross-section through the ion source taken along the line A-A of FIG. 2.

Referring to the drawings, an ion source 1 comprises a chamber 2 formed from an electrically conducting material.

An electrode holder 3 is mounted to the chamber 2. The electrode holder supports a point electrode 4 which extends in the chamber. A power supply 11 is connected between the electrode 4 and the chamber 2.

The chamber 2 defines an inlet 5. One end of a capillary tube 6 is mounted to the inlet 5 with a fluid flow connection. The opposite end of the capillary tube 5 is open. The capillary tube 6 extends through an elongate annular heater 7, comprising an electrical heater element. The heater is, in turn, is mounted in an outer tube 8.

The chamber 2 also defines an outlet 9 formed by a substantially circular opening with a diameter of about 2 mm. The outlet 9 is connected to an inlet of a suitable mass spectrometer 10 or other suitable analyser, which is electrically isolated from the chamber 2. Electrostatic/electrodynamic lenses are provided in the chamber arranged to direct ions generated in the chamber through the outlet and hence into the mass spectrometer 10.

Any suitable mass spectrometer or other analyser may be used. Time of flight and quadrupole mass spectrometers are suitable.

The chamber 2 is also connected to a vacuum source arranged to reduce the pressure in the chamber.

The interior of the mass spectrometer is also connected to a vacuum source arranged to reduce pressure within the spectrometer, beyond the orifice connecting it to the chamber 2, to a pressure lower than that within the chamber 2.

In use, pressure within the chamber 2 is reduced to around 1 torr using the vacuum source. The vacuum source and the length and internal diameter of the capillary tube 6 are chosen and/or controlled so that this desired pressure is maintained.

The power supply 11 is arranged to apply a DC potential of about 200-400 volts DC to the electrode 4 relative to the chamber.

Optionally, the heater 7 may be operated to raise the temperature of the capillary tube 6 to a desired temperature depending on the samples it is desired to analyse. Typically the heater is arranged to heat the capillary tube up to around 250° C. The actual temperature is chosen depending on the type of sample it is desired to detect.

Pressure beyond the inlet to the mass spectrometer 10 is reduced still further to a pressure in the region of $10^{-2}$ to $10^{-4}$ torr, and typically around $10^{-3}$ torr. The size of the orifice between the chamber and the mass spectrometer and the vacuum source connected to the mass spectrometer are chosen so that this lower pressure is maintained within the mass spectrometer, the orifice creating a pressure step between the chamber 2 and mass spectrometer 10.

The reduced pressure in the chamber causes atmospheric air to be drawn into the chamber 2 through the capillary 6. Any sample of interest present in the air will be drawn into the chamber together with the air.

The electrical potential on the electrode 4 generates a corona discharge in the chamber causing ionisation of molecules within the chamber, predominantly molecules present in atmospheric air which dominate in the chamber. These ion species may chemically ionise any sample molecules present in the chamber, as discussed further below.

The lower pressure maintained within the mass spectrometer 10 causes gas to flow from the chamber 2 into the mass spectrometer. This gas flow, in combination with DC and RF electrical fields provided by the lenses in the chamber, sweep ions generated in the chamber into the mass spectrometer, via the orifice, for analysis. The mass spectrometer comprises an RF ion guide, which operates at a frequency of between 1 and 2 Mhz and a peak to peak voltage of around 200 volts. Operation of the mass spectrometer is conventional and so is not described in further detail.

Figure 4:
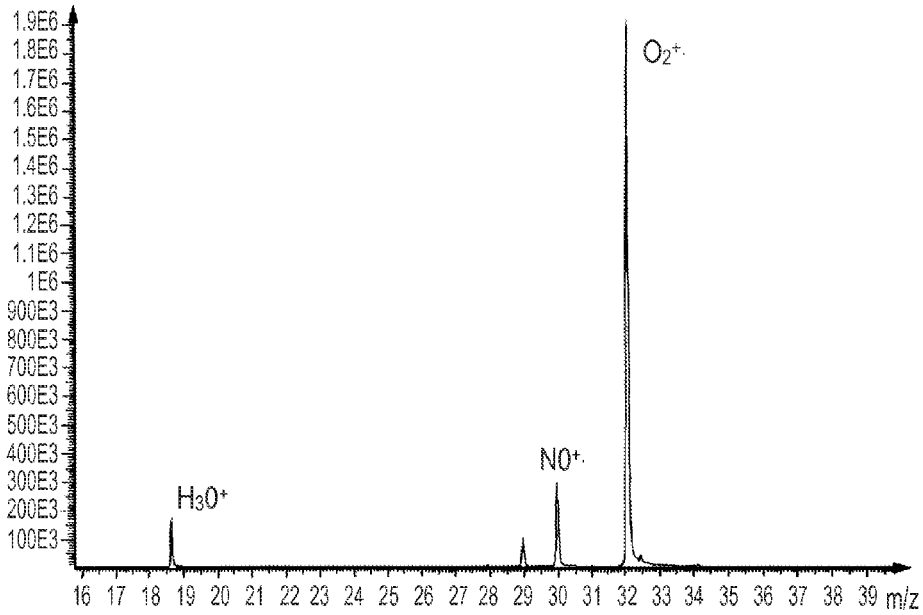
FIGS. 4 to 8 are mass spectra produced by the mass spectrometer of FIG. 1.
Figure 5:
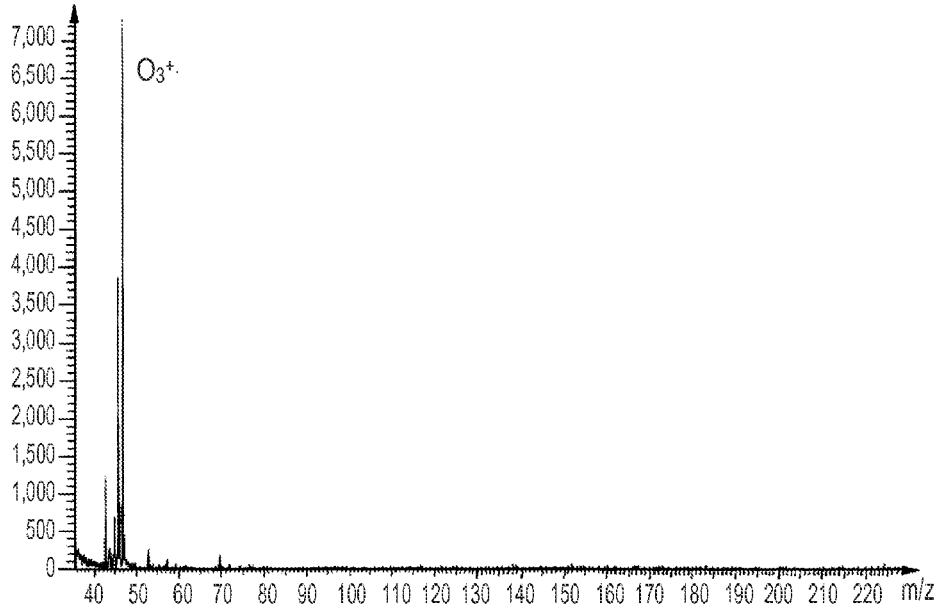

Analysis of an uncontaminated sample of atmospheric air shows that by far the most abundant excited ion species are ionised bi and trimolecular Oxygen, as shown in FIGS. 4 and 5.

In the event that neutral sample molecules (or indeed ions) are introduced into the chamber, the tendency is for the excited molecular Oxygen species to interact with the sample molecules or ions to generate analyte ions in the form of radical ions via electron removal or capture, protonated/cationised ions via protonation or hydride extraction mechanisms. That is to say, the excited Oxygen species chemically ionise sample molecules/ions present in the chamber producing ions, largely without fragmentation. The resulting analyte ions are also swept into the mass spectrometer for analysis and will produce outputs from the mass spectrometer which are superposed on the spectrum of FIGS. 4 and 5.

Figure 6:
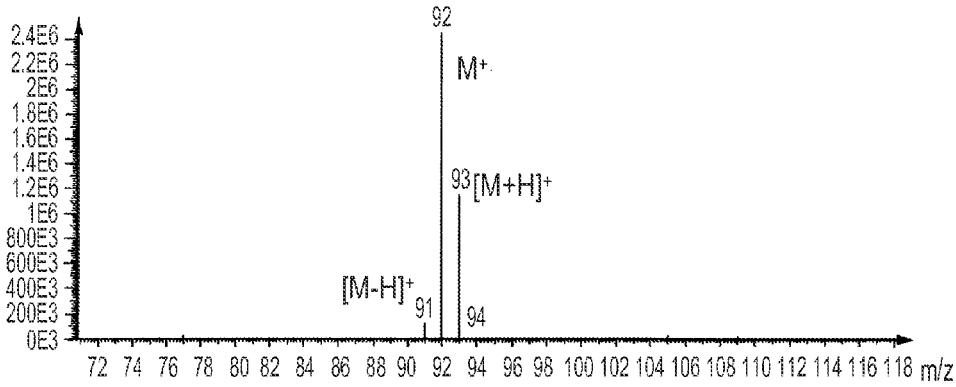

FIG. 6 shows a mass spectrum produced where Toluene was present in air drawn into the chamber 2. In this example, interaction between the neutral Toluene molecules and excited Oxygen species generates ionised Toluene species through electro removal or capture.

Figure 7:
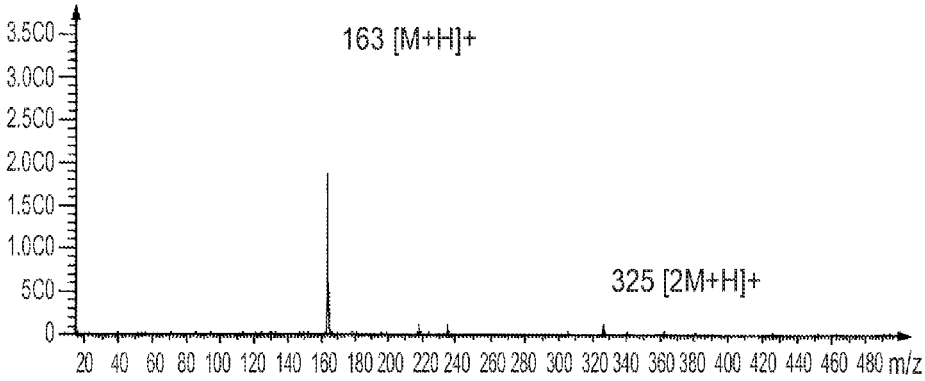

FIG. 7 shows a mass spectrum produced where Nicotine was present in the air drawn into the chamber 2. In this example, interaction between the neutral Nicotine molecules and excited Oxygen species generates ionised Nicotine species via protonation.

Figure 8:
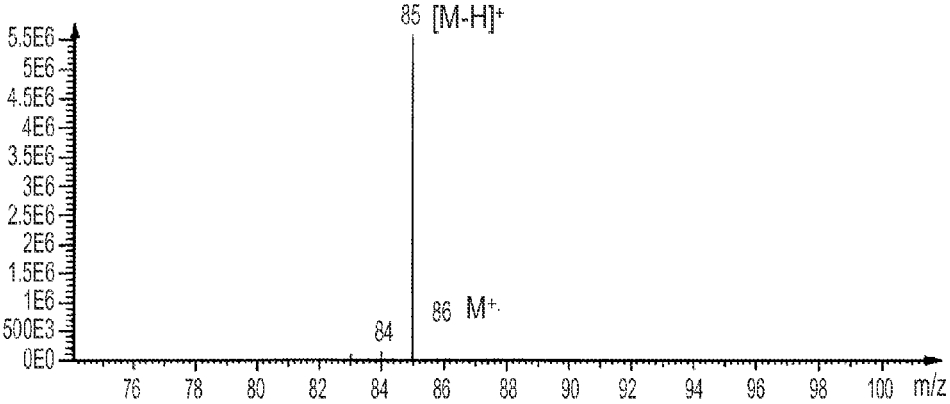

FIG. 8 shows mass spectrum produced where Hexane was present in the air drawn into the chamber 2. In this example, interaction between the neutral Hexane molecules and excited Oxygen species generates ionised Hexane species via hydride extraction.

In each of these examples analyte molecules of interest were present in air drawn into the chamber, and the apparatus is ideally suited for analysis of air to detect substances of interest, particularly in sniffing applications. Where a solid or liquid sample is desired to be analysed this can be achieved by introducing a sample directly into the chamber or dispersing it in air flowing into the chamber through the capillary such as by direct injection, nebulisation, vaporisation or ablation of the sample. Conventional atmospheric ionisation techniques could also be employed to generate sample ions, which can then be drawn into the chamber through the capillary.

The above embodiment is described by way of example only. Many variations are possible without departing from the scope of the invention as defined in the appended claims.

The invention claimed is:

1. A method of ionising a sample for analysis including the steps of drawing atmospheric air containing the sample into a chamber in which the pressure is less than atmospheric pressure, heating the air and creating an electrical discharge by applying a DC electrical potential in the range 100-500 volts to an electrode in the chamber thereby to bring air molecules in the chamber into an excited state and permitting the excited state molecules to react with the sample to generate sample ions.

2. A method as claimed in claim 1 wherein the pressure in the chamber is less than 2 torr.

3. A method as claimed in claim 2 wherein the pressure in the chamber is about 1 torr.

4. A method as claimed in claim 1 wherein atmospheric air is drawn into the chamber through a capillary tube.

5. A method as claimed in claim 1 wherein the electrical potential is in the range 200-400 volts.

6. A method as claimed in claim 1 comprising the step of sweeping ions generated in the chamber into an analyser.

7. A method as claimed in claim 6 wherein the ions pass through a pressure step into the analyser, into a region where the pressure is lower than that in the chamber.

8. A method as claimed in claim 7 wherein the pressure in the analyser is equal to or less than $10^{-2}$ torr.

9. A method as claimed in claim 7 wherein the pressure in the analyser is in the range $10^{-2}$ torr to $10^{-4}$ torr.

10. A method as claimed in claim 1 where no, or appreciably no, neutral carrier gas is introduced into the chamber.

11. An ion source comprising a chamber, an electrode disposed in the chamber, a power supply arranged to maintain the electrode at a DC potential in the range 100-500 volts relative to the chamber, an inlet to the chamber, a heater arranged to heat air drawn into the chamber through the inlet and a vacuum source connected to the chamber, the vacuum source and inlet being configured to maintain pressure in the chamber below atmospheric pressure, when the inlet is open to the atmosphere.

12. An ion source as claimed in claim 11 wherein the vacuum source and inlet are configured to maintain pressure within the chamber below 2 torr, when the inlet is open to the atmosphere.

13. An ion source as claimed in claim 11 wherein the inlet comprises a capillary tube.

14. An ion source as claimed in claim 11 wherein the potential is in the range 200-400 volts.

15. An ion source as claimed in claim 11 wherein the chamber comprises an outlet and electric and/or electrostatic lenses are provided in the chamber arranged to sweep ions formed in the chamber through the outlet.

16. An ion source as claimed in claim 11 wherein the chamber comprises an outlet of substantially circular cross-section and diameter about 2 mm.

17. Apparatus for analysis comprising an ion source as claimed in claim 11 connected to an analyser, the analyser being provided with a vacuum source arranged to maintain a region of the analyser connected to the ion source at a pressure lower than that in the chamber of the ion source.

18. Apparatus as claimed in claim 17 wherein the analyser and associated vacuum source are arranged to maintain pressure within the analyser at or below $10^{-2}$ torr.

19. Apparatus as claimed in claim 17 wherein the analyser is a mass spectrometer.

* * * * *